US011725657B2

(12) United States Patent
Wei et al.

(10) Patent No.: US 11,725,657 B2
(45) Date of Patent: Aug. 15, 2023

(54) SEALING STRUCTURE AND SCROLL AIR COMPRESSOR HAVING SAME

(71) Applicant: GREE GREEN REFRIGERATION TECHNOLOGY CENTER CO., LTD. OF ZHUHAI, Zhuhai (CN)

(72) Inventors: Huijun Wei, Zhuhai (CN); Yelin Li, Zhuhai (CN); Zhengliang Shi, Zhuhai (CN); Xiaoqing Guo, Zhuhai (CN); Xiaoxiao Chen, Zhuhai (CN)

(73) Assignee: GREE GREEN REFRIGERATION TECHNOLOGY CENTER CO., LTD. OF ZHUHAI, Zhuhai (CN)

( * ) Notice: Subject to any disclaimer, the term of this patent is extended or adjusted under 35 U.S.C. 154(b) by 0 days.

(21) Appl. No.: 17/277,290

(22) PCT Filed: Dec. 5, 2018

(86) PCT No.: PCT/CN2018/119288

§ 371 (c)(1),
(2) Date: Mar. 17, 2021

(87) PCT Pub. No.: WO2020/087654

PCT Pub. Date: May 7, 2020

(65) Prior Publication Data

US 2022/0034322 A1 Feb. 3, 2022

(30) Foreign Application Priority Data

Nov. 1, 2018 (CN) ..... 201811292896.X

(51) Int. Cl.
*F04C 18/02* (2006.01)
*F04C 27/00* (2006.01)
(Continued)

(52) U.S. Cl.
CPC ..... *F04C 18/0284* (2013.01); *F04C 18/0215* (2013.01); *F04C 27/005* (2013.01);
(Continued)

(58) Field of Classification Search
CPC ..... F04C 18/0284; F04C 18/0215; F04C 27/005; F04C 27/00; F04C 2230/92;
(Continued)

(56) References Cited

U.S. PATENT DOCUMENTS 4,415,317 A * 11/1983 Butterworth ..... F04C 18/0215 277/379
4,437,820 A * 3/1984 Terauchi ..... F04C 18/0215 418/142

(Continued)

FOREIGN PATENT DOCUMENTS

CN 1148672 A 4/1997
CN 101319672 A 12/2008

(Continued)

OTHER PUBLICATIONS

English Machine Translation of JPH08232858A via Espacenet (Year: 1996).*

*Primary Examiner* — Dominick L Plakkoottam
*Assistant Examiner* — Paul W Thiede
(74) *Attorney, Agent, or Firm* — Kilpatrick Townsend & Stockton LLP

(57) ABSTRACT

Disclosed are a sealing structure and a scroll air compressor having the same. The sealing structure includes an orbiting scroll including an orbiting scroll spiral tooth, the orbiting scroll spiral tooth being provided with an orbiting scroll spiral tooth groove, an orbiting scroll wear-resistant sealing strip being provided in the orbiting scroll spiral tooth groove, a stationary scroll including a stationary scroll spiral tooth matched with the orbiting scroll spiral tooth, the stationary scroll spiral tooth being provided with a stationary scroll spiral tooth groove, a stationary scroll wear-resistant sealing strip is provided in the stationary scroll spiral tooth groove, the wear-resistant sealing strip is divided into sections including a high-temperature and high-pressure section and a medium-temperature and medium-pressure section.

13 Claims, 6 Drawing Sheets

(51) Int. Cl.
*F01C 7/00* (2006.01)
*F01C 19/08* (2006.01)
*F01C 19/00* (2006.01)

(52) U.S. Cl.
CPC ..... *F01C 19/005* (2013.01); *F01C 19/08* (2013.01); *F04C 27/00* (2013.01); *F04C 2230/92* (2013.01); *F04C 2250/00* (2013.01); *F05C 2201/021* (2013.01); *F05C 2201/0409* (2013.01); *F05C 2201/0439* (2013.01); *F05C 2225/04* (2013.01); *F05C 2251/02* (2013.01); *F05C 2251/10* (2013.01); *F05C 2253/16* (2013.01)

(58) Field of Classification Search
CPC .... F04C 2250/00; F01C 19/005; F01C 19/08; F05C 2201/021; F05C 2201/0409; F05C 2201/0439; F05C 2225/04; F05C 2251/02; F05C 2251/10; F05C 2253/16; F16J 15/16; F16J 15/54; F16J 15/56
See application file for complete search history.

(56) References Cited

U.S. PATENT DOCUMENTS 4,462,771 A * 7/1984 Teegarden ..... F04C 18/0284 277/379
4,740,143 A * 4/1988 Nakamura ..... F04C 27/005 418/142
5,775,892 A * 7/1998 Miyasaka ..... C25D 11/06 123/193.2
6,695,597 B2 * 2/2004 Kimura ..... F04C 18/0215 418/142
7,195,496 B2 * 3/2007 Biermann ..... H01R 12/7058 439/79
7,364,418 B2 * 4/2008 Masuda ..... F04C 27/005 277/379
9,353,746 B2 * 5/2016 Hockliffe ..... F04C 18/0215
9,989,152 B2 * 6/2018 Putkowski ..... F16J 9/20
2002/0028150 A1 * 3/2002 Kawabata ..... F04C 18/0284 418/55.4
2003/0063989 A1 * 4/2003 Rinella ..... F04C 27/005 418/55.2
2005/0249623 A1 * 11/2005 Tsuchiya ..... F04C 27/005 418/55.4
2007/0071626 A1 * 3/2007 Tsuchiya ..... F04C 27/005 418/55.4
2011/0286871 A1 11/2011 Moro et al.
2014/0234149 A1 * 8/2014 Lee ..... F04C 27/003 418/55.4

FOREIGN PATENT DOCUMENTS

CN 202149031 U 2/2012
CN 108699908 A 10/2013
CN 206917856 U 1/2018
CN 207945082 U 10/2018
EP 1132573 A2 * 9/2001 ..... F04C 18/0215
JP H08232858 A * 9/1996
JP H08261171 10/1996
JP 2007231796 A 9/2007
JP 2016102486 A 6/2016
KR 20000046639 A * 7/2000

* cited by examiner

SEALING STRUCTURE AND SCROLL AIR COMPRESSOR HAVING SAME

CROSS REFERENCE TO RELATED APPLICATION

The present application is a US National Stage of International Application No. PCT/CN2018/119288, filed Dec. 5, 2018, which claims priority to Chinese Patent Application with No. 201811292896.X and filed on Nov. 1, 2018, the content of which are expressly incorporated herein by reference in their entireties.

FIELD

The present disclosure relates to the field of air compressor technology, and particularly relates to a sealing structure and a scroll air compressor having the same.

BACKGROUND

The air compressor is a basic product of the industrial modernization, a core device of the pneumatic system, and is a device that converts the mechanical energy into the gas pressure energy, and is a pressure generating device configured to compress the air. Because the scroll air compressor has no reciprocating mechanism, it has simple structure, small size, light weight and easy automation, then it is widely used.

The sealing is a main factor affecting the performance of scroll air compressors. When the scroll air compressor compresses the air, the tooth surface of the orbiting scroll spiral tooth constantly rubs against the air pressure groove of the stationary scroll, and the tooth surface of the stationary scroll spiral tooth constantly rubs against the sealing plate of the orbiting scroll, and there is no sealing device for damping, buffering and noise reduction provided between the orbiting scroll and the stationary scroll.

Therefore, a new sealing structure is designed. Such sealing structure can act as a buffer and a damper when the orbiting scroll is engaged with the stationary scroll, and can also prevent impurities from entering the compression chamber, enhancing the sealing between the orbiting scroll and the stationary scroll, improving the performance and reliability of the air compressor, increasing the service life of the scrolls, and reducing the maintenance cost of the air compressor.

The Chinese Patent with the Authorization Announcement No. CN105909518B discloses a scroll air compressor assembly. A first wear-resistant part is provided in an orbiting scroll spiral tooth groove, a second wear-resistant part is provided in a stationary scroll spiral tooth groove, and an elastic rubber hose is provided in a damping groove of the stationary scroll. The temperature at the center of the scroll is higher, a material of the sealing strip in this area should have an excellent temperature resistance. The temperature at the periphery of the scroll is lower than that at the center of the scroll, so the material of the sealing strip in this area should have a temperature resistance which is not as high as that at the center of the scroll, but the wear-resistant parts in this patent (i.e., the sealing strips) are all embedded in the grooves of the orbiting scroll and the stationary scroll, and are not assembled in sections. Moreover, the cross-sectional of the elastic rubber hose in the damping groove of the stationary scroll is in a shape of a circle, the effect of damping can be achieved.

The Chinese Patent with the Authorization Publication No. CN106523358A discloses that the outer and inner scroll grooves of the orbiting scroll and the stationary scroll are equipped with intermediate sealing components, and a bottom surface of the intermediate sealing component is provided with a support ring made of an elastic material. However, the scroll in this patent is provided with a shoulder, and the shoulder divides the compression chamber into a front compression chamber and a rear compression chamber. Therefore, the scroll teeth of the stationary scroll are divided into three sections, and the scroll teeth of the orbiting scroll are divided into two sections, and the intermediate sealing components are also installed in the outer and inner scroll grooves of the stationary scroll and the orbiting scroll in sections.

SUMMARY

The present disclosure solves the following problems.

1. The sealing strips on the scroll spiral tooth known to the inventors are all assembled in the whole strip, and are not assembled in sections by taking into account the temperature difference in each area. If the entire sealing strip is assembled with a material having a better temperature resistance, the material cost is higher. If the entire sealing strip is assembled with a material having a general temperature resistance, the sealing strip can fail faster and the service life thereof is shortened; and replacement of a new wear-resistant sealing strip also increases the maintenance cost.

2. Most scroll air compressors known to the inventors are not equipped with sealing devices having functions of damping, buffering and noise reduction. The air compressor is prone to generate loud noises during operation, and the orbiting scroll and stationary scroll also fail due to wear and impact, which can increase the power consumption of the air compressor and reduce the performance and reliability of the air compressor.

3. Some scroll air compressors are equipped with sealing devices having the functions of damping, buffering and dust prevention, but the cross-section thereof is in a shape of a circle, although which can act as damper and buffer, the sealing and noise reduction effect of the sealing structure is lower.

The present disclosure provides a sealing structure, including:

an orbiting scroll including an orbiting scroll spiral tooth, in which the orbiting scroll spiral tooth is provided with an orbiting scroll spiral tooth groove, an orbiting scroll wear-resistant sealing strip is provided in the orbiting scroll spiral tooth groove, the orbiting scroll wear-resistant sealing strip comprises the orbiting scroll wear-resistant sealing strip in a high-temperature and high-pressure section and the orbiting scroll wear-resistant sealing strip in a medium-temperature and medium-pressure section, a thickness of the orbiting scroll wear-resistant sealing strip is greater than a depth of the orbiting scroll spiral tooth groove;

a stationary scroll including a stationary scroll spiral tooth matched with the orbiting scroll spiral tooth, in which the stationary scroll spiral tooth is provided with a stationary scroll spiral tooth groove, a stationary scroll wear-resistant sealing strip is provided in the stationary scroll spiral tooth groove, the stationary scroll wear-resistant sealing strip comprises the stationary scroll wear-resistant sealing strip in the high-temperature and high-pressure section and the stationary scroll wear-resistant sealing strip in the medium-temperature and medium-pressure section, a thickness of the stationary scroll wear-resistant sealing strip is greater than a depth of the stationary scroll spiral tooth groove.

Furthermore, the stationary scroll is provided with a damping sealing groove, an elastic damping component is provided in the damping sealing groove, and a damping wear-resistant sealing strip is provided on the orbiting scroll, the damping wear-resistant sealing strip abuts against the elastic damping component, an abutting portion of the damping wear-resistant sealing strip and the elastic damping component is lower than an upper end surface of the damping sealing groove; or, the orbiting scroll is provided with the damping sealing groove, the elastic damping component is provided in the damping sealing groove, the damping wear-resistant sealing strip is provided on the stationary scroll, the damping wear-resistant sealing strip abuts against the elastic damping component, the abutting portion is lower than the upper end surface of the damping sealing groove.

Furthermore, the thickness of the orbiting scroll wear-resistant sealing strip in the high-temperature and high-pressure section is greater than the thickness of the orbiting scroll wear-resistant sealing strip in the medium-temperature and medium-pressure section, the orbiting scroll spiral tooth groove accordingly comprises the orbiting scroll spiral tooth groove in the high-temperature and high-pressure section and the orbiting scroll spiral tooth groove in the medium-temperature and medium-pressure section, the depth of the orbiting scroll spiral tooth groove in the high-temperature and high-pressure section is greater than the depth of the orbiting scroll spiral tooth groove in the medium-temperature and medium-pressure section; or, the thickness of the stationary scroll wear-resistant sealing strip in the high-temperature and high-pressure section is greater than the thickness of the stationary scroll wear-resistant sealing strip in the medium-temperature and medium-pressure section, the stationary scroll spiral tooth groove accordingly comprises the stationary scroll spiral tooth groove in the high-temperature and high-pressure section and the stationary scroll spiral tooth groove in the medium-temperature and medium-pressure section, the depth of the stationary scroll spiral tooth groove in the high-temperature and high-pressure section is greater than the depth of the stationary scroll spiral tooth groove in the medium-temperature and medium-pressure section.

Furthermore, cross sections of the orbiting scroll wear-resistant sealing strip, the stationary scroll wear-resistant sealing strip, and the damping wear-resistant sealing strip are in a shape of a square.

Furthermore, a cross section of the elastic damping component is in a shape of a circle or a circular tube, an outer diameter of the circle or the circular tube is between one half and three fifths of a depth of the damping sealing groove.

Furthermore, a thickness of the damping wear-resistant sealing strip is between one half and three fifths of the depth of the damping sealing groove.

Furthermore, a temperature resistance of the orbiting scroll wear-resistant sealing strip in the high-temperature and high-pressure section, a temperature resistance of the orbiting scroll wear-resistant sealing strip in the medium-temperature and medium-pressure section, and a temperature resistance of the damping sealing strip decrease in sequence.

Furthermore, a width of the orbiting scroll wear-resistant sealing strip is the same as that of the stationary scroll wear-resistant sealing strip.

Furthermore, surfaces of the orbiting scroll wear-resistant sealing strip, the stationary scroll wear-resistant sealing strip, and the damping wear-resistant sealing strip are smooth and flat.

Furthermore, the orbiting scroll wear-resistant sealing strip in the high-temperature and high-pressure section and/or the stationary scroll wear-resistant sealing strip in the high-temperature and high-pressure section are made of a PTFE composite material comprising copper powder, molybdenum disulfide, carbon fiber or glass fiber, and a temperature resistance range thereof is −240° C. to 280° C.;

the orbiting scroll wear-resistant sealing strip in the medium-temperature and medium-pressure section and/or the stationary scroll wear-resistant sealing strip in the medium-temperature and medium-pressure section are made of the PTFE composite material comprising LCP, molybdenum disulfide, carbon fiber or glass fiber, and a temperature resistance range thereof is −240° C. to 280° C.;

the damping wear-resistant sealing strip is made of the PTFE composite material comprising PI, molybdenum disulfide, carbon fiber or glass fiber, and the temperature resistance range of the damping wear-resistant sealing strip 50 is −220° C. to −250° C.;

a material of the elastic damping component is any one of silica gel, latex, or polyethylene, or any one of composite materials with silica gel, latex, or polyethylene as a matrix.

Furthermore, a heat dissipation groove is provided on the stationary scroll, the damping sealing groove is provided between the stationary scroll spiral tooth and the heat dissipation groove; or, the heat dissipation groove is provided on the orbiting scroll, and the damping sealing groove is provided between the orbiting scroll spiral tooth and the heat dissipation groove.

Furthermore, elasticity and plasticity of the elastic damping component is better than that of the damping wear-resistant sealing strip.

Furthermore, a base material of one of the orbiting scroll and the stationary scroll is a cast aluminum alloy or a forged aluminum alloy, and a base material of the other is powder metallurgy or a cast iron; or, the base materials of the orbiting scroll and the stationary scroll are both the cast aluminum alloy or the forged aluminum alloy, and one or both of the base materials of the orbiting scroll and the stationary scroll are treated with hard anodic oxidation or micro-arc oxidation.

The present disclosure further provides a scroll air compressor including the above-mentioned sealing structure.

1. The orbiting scroll spiral tooth and stationary scroll spiral tooth of the air compressor are divided into a high-temperature and high-pressure section and a medium-temperature and medium-pressure section. The sealing strip with excellent temperature resistance is embedded in the spiral tooth groove in the high-temperature and high-pressure section, and the sealing strip with general temperature resistance is embedded in the medium-temperature and medium-pressure section. In such a way, the costs of use and maintenance of the material are reduced.

2. A sealing device having functions of damping, buffering and noise reduction is provided, and the sealing device consists of a wear-resistant sealing strip with a cross section in the shape of a square and a sealing tube or a sealing ring with a cross section in the shape of a circle. The buffer contact surface of the wear-resistant sealing strip in contact with the surface of the scroll is flat, which improves the performance of sealing and noise reduction. The bottom surface of the wear-resistant sealing strip is equipped with a sealing ring in the shape of a circle or a circular tube to improve the performance of damping and buffering.

3. The direct friction loss of the fixed spiral tooth and the orbiting spiral tooth when the air is compressed becomes the friction loss of the wear-resistant sealing strips of the polymer material with better damping performance, which greatly reduces the power consumption caused by the friction. The replacement of the wear-resistant sealing strip is low in cost and is easy, which improves the performance of the air compressor compressing the air and greatly reduces the use cost of the air compressor.

Figure 1:
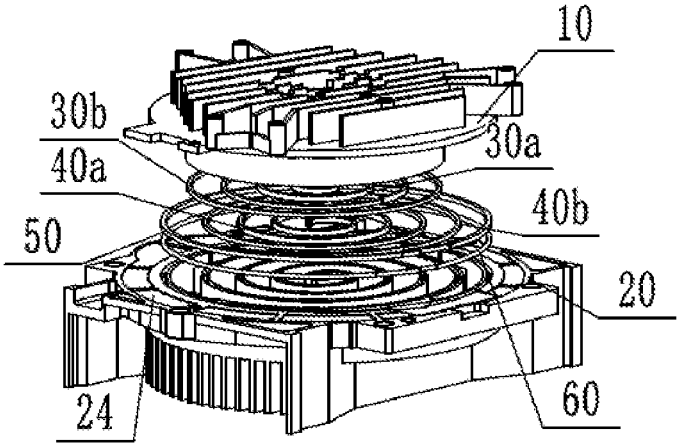
FIG. 1 is a schematic structure diagram of a sealing structure according to the present disclosure.

Reference signs: 10, orbiting scroll; 11, orbiting scroll spiral tooth; 12, orbiting scroll spiral tooth groove; 12*a*, orbiting scroll spiral tooth groove in a high-temperature and high-pressure section; 12*b*, orbiting scroll spiral tooth groove in a medium-temperature and medium-pressure section; 20, stationary scroll; 21, stationary scroll spiral tooth; 22, stationary scroll spiral tooth groove; 22*a*, stationary scroll spiral tooth groove in a high-temperature and high-pressure section; 22*b*, stationary scroll spiral tooth groove in a medium-temperature and medium-pressure section; 23, damping sealing groove; 24, heat dissipation groove; 30, orbiting scroll wear-resistant sealing strip; 30*a*, orbiting scroll wear-resistant sealing strip in a high-temperature and high-pressure section; 30*b*, orbiting scroll wear-resistant sealing strip in a medium-temperature and medium-pressure section; 40, stationary scroll wear-resistant sealing strip; 40*a*, stationary scroll wear-resistant sealing strip in a high-temperature and high-pressure section; 40*b*, stationary scroll wear-resistant sealing strip in a medium-temperature and medium-pressure section; 50, damping wear-resistant sealing strip; 60, elastic damping component.

DETAILED DESCRIPTION

The present disclosure will be further described in detail below in conjunction with the accompanying drawings.

As for the problems of high cost and short life due to the use of an entire sealing strip, and lower sealing and noise reduction effects due to the use of a sealing device with a circular cross section in the related art, the present disclosure provides a sealing structure.

The sealing structure includes: an orbiting scroll and a stationary scroll. The orbiting scroll includes an orbiting scroll spiral tooth; the orbiting scroll spiral tooth is provided with an orbiting scroll spiral tooth groove; and in the orbiting scroll spiral tooth groove is provided an orbiting scroll wear-resistant sealing strip which includes an orbiting scroll wear-resistant sealing strip in a high-temperature and high-pressure section and an orbiting scroll wear-resistant sealing strip in a medium-temperature and medium-pressure section. A thickness of the orbiting scroll wear-resistant sealing strip is greater than a depth of the orbiting scroll spiral tooth groove. The stationary scroll includes a stationary scroll spiral tooth matched with the orbiting scroll spiral tooth; the stationary scroll spiral tooth is provided with a stationary scroll spiral tooth groove; and in the stationary scroll spiral tooth groove is provided a stationary scroll wear-resistant sealing strip. The stationary scroll wear-resistant sealing strip includes a stationary scroll wear-resistant sealing strip in a high-temperature and high-pressure section and a stationary scroll wear-resistant sealing strip in a medium-temperature and medium-pressure section. The thickness of the stationary scroll wear-resistant sealing strip is greater than the depth of the stationary scroll spiral tooth groove.

The stationary scroll is provided with a damping sealing groove; an elastic damping component is provided in the damping sealing groove; and a damping wear-resistant sealing strip is provided on the orbiting scroll. The damping wear-resistant sealing strip abuts against the elastic damping component, and an abutting portion is lower than an upper end surface of the damping sealing groove; or, a damping sealing groove is provided on the orbiting scroll, and in the damping sealing groove is provided an elastic damping component; the stationary scroll is provided with a damping wear-resistant sealing strip; the damping wear-resistant sealing strip abuts against the elastic damping component, and the abutting portion is lower than the upper end surface of the damping sealing groove.

In some embodiments, the sealing structure of the present disclosure is applied to a scroll air compressor.

The present disclosure reduces the costs of the use and maintenance of the sealing strip material. The buffer contact surface of the wear-resistant sealing strip in contact with the surface of the scroll is flat, which improves the performance of sealing and noise reduction. The bottom surface of the wear-resistant sealing strip is fitted with a sealing ring having a cross section in a shape of a circle or a circular tube, which improves the damping and buffering performances. In one embodiment, the performance of the air compressor compressing the air is improved, and the use cost of the air compressor is simultaneously greatly reduced.

In one embodiment, the sealing structure shown in FIG. 1 is taken as an example for detailed description.

Figure 2:
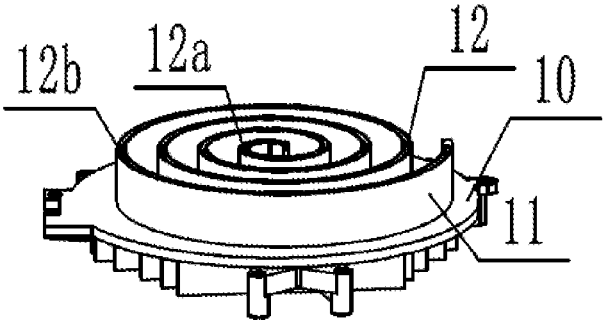
FIG. 2 is a schematic structure diagram of an orbiting scroll.
Figure 3:
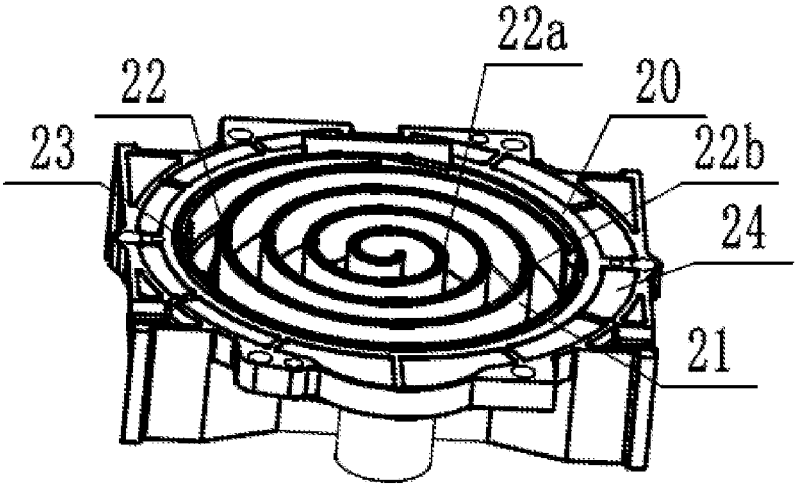
FIG. 3 is a schematic structure diagram of a stationary scroll.

An air compressor assembly in FIG. 1 includes an orbiting scroll 10 as shown in FIG. 2 and a stationary scroll 20 as shown in FIG. 3. The spiral teeth of the orbiting scroll and the stationary scroll are divided into a high-temperature and high-pressure section and a medium-temperature and medium-pressure section. The stationary scroll 20 is provided with a stationary scroll spiral tooth 21; and a top portion of the stationary scroll 21 is provided with a stationary scroll spiral tooth groove 22, in order to be able to embed the stationary scroll wear-resistant sealing strip 40; the orbiting scroll 10 is provided with an orbiting scroll spiral tooth 11 matched with the stationary scroll spiral tooth 21 on the stationary scroll 20; the top portion of the orbiting scroll spiral tooth 11 is provided with an orbiting scroll spiral tooth groove 12, in order to be able to embed the orbiting scroll wear-resistant sealing strip 30. In some embodiments, a width of the orbiting scroll wear-resistant sealing strip in the high-temperature and high-pressure section and the medium-temperature and medium-pressure section is the same as the width of the stationary scroll wear-resistant sealing strip in the high-temperature and high-pressure section and the medium-temperature and medium-pressure section; and the width is slightly smaller than the width of the spiral tooth groove. The thickness of the wear-resistant sealing strip in the high-temperature and high-pressure section is greater than the thickness of the wear-resistant sealing strip in the medium-temperature and medium-pressure section; and the thickness of the wear-resistant sealing strip in the high-temperature and high-pressure section and the medium-temperature and medium-pressure section is slightly higher than the depth of the spiral tooth groove. The width of the damping wear-resistant sealing strip in the damping sealing device is slightly smaller than the width of the damping groove; and the thickness of the damping wear-resistant sealing strip is between one half and three fifths of the depth of the damping groove.

During operation, the orbiting scroll 10 is snap-fitted with the stationary scroll 20; the orbiting scroll spiral tooth 11 is engaged with the stationary scroll spiral tooth 21, to move eccentrically by controlling the orbiting scroll 10 to make the orbiting scroll spiral tooth 11 move along a side wall of the stationary scroll spiral tooth groove 22, and the formed crescent-shaped compression chambers compress the air step by step. When air is compressed, the tooth surfaces of the stationary scroll spiral tooth 21 and the orbiting scroll spiral tooth 11 are no longer worn due to friction, and replaced by the friction loss of the wear-resistant sealing strips (including the orbiting scroll wear-resistant sealing strip 30 and the stationary scroll wear-resistant sealing strip 40). Moreover, the cost of replacing the wear-resistant sealing strip is lower, and the replacement is convenient, which greatly reduces the use cost of the air compressor and improves the reliability, performance and service life of the air compressor.

Figure 4:
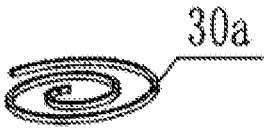
FIG. 4 is a schematic structure diagram of a wear-resistant sealing strip in a high-temperature and high-pressure section of an orbiting scroll.
Figure 5:
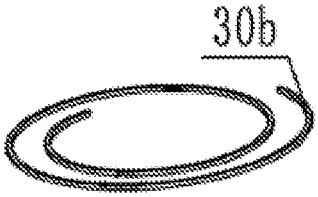
FIG. 5 is schematic a structure diagram of a wear-resistant sealing strip in a medium-temperature and medium-pressure section of an orbiting scroll.
Figure 6:
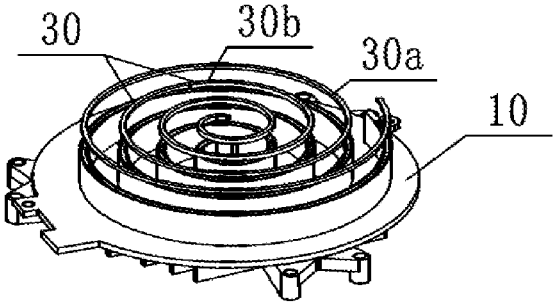
FIG. 6 is a part composition diagram of wear-resistant sealing strips in a high-temperature and high-pressure section and in a medium-temperature and medium-pressure section, and an orbiting scroll.
Figure 7:
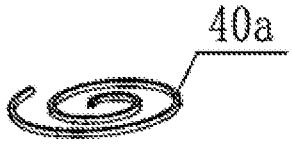
FIG. 7 is a structure diagram of a wear-resistant sealing strip in a high-temperature and high-pressure section of a stationary scroll.
Figure 8:
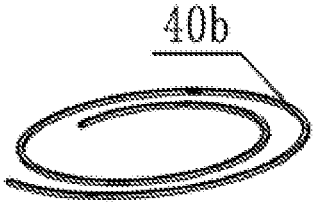
FIG. 8 is a structure diagram of a wear-resistant sealing strip in a medium-temperature and medium-pressure section of a stationary scroll.

Referring to FIGS. 4-6, the orbiting scroll wear-resistant sealing strip 30 includes an orbiting scroll wear-resistant sealing strip 30*a* in a high-temperature and high-pressure section and an orbiting scroll wear-resistant sealing strip 30*b* in a medium-temperature and medium-pressure section; the orbiting scroll wear-resistant sealing strip 30*a* in a high-temperature and high-pressure section is embedded in an orbiting scroll spiral tooth groove 12*a* in the high-temperature and high-pressure section; the orbiting scroll wear-resistant sealing strip 30*b* in the medium-temperature and medium-pressure section is embedded in the orbiting scroll spiral tooth groove 12*b* in the medium-temperature and medium-pressure section. The structure of the stationary scroll wear-resistant sealing strip 40 is similar to that of the orbiting scroll wear-resistant sealing strip 30, with opposite rotation directions. The stationary scroll wear-resistant sealing strip 40 includes a stationary scroll wear-resistant sealing strip 40*a* in a high-temperature and high-pressure section as shown in FIG. 7 and a stationary scroll wear-resistant sealing strip 40*b* in a medium-temperature and medium-pressure section as shown in FIG. 8. In some embodiments, the wear-resistant sealing strip in the high-temperature and high-pressure section is PTFE with an added filler such as copper powder, molybdenum disulfide and carbon fiber or glass fiber, etc., and a temperature resistance range thereof is −240° C. to 280° C. The wear-resistant sealing strip in the medium-temperature and medium-pressure section is PTFE with an added filler such as liquid crystal polymer (LCP), molybdenum disulfide, carbon fiber or glass fiber, etc., and the temperature resistance range thereof is −240° C. to 280° C. The wear-resistant sealing strip in the damping section is PTFE with an added filler such as polyimide (PI), molybdenum disulfide, carbon fiber or glass fiber, etc., and the temperature resistance range thereof is −220° C. to 250° C. The temperature resistance and wear resistance of the wear-resistant sealing strip in the high-temperature and high-pressure section, the medium-temperature and medium-pressure section and the damping section are provided as that: wear-resistant sealing strip in the high-temperature and high-pressure section wear-resistant sealing strip in the medium-temperature and medium-pressure section wear-resistant sealing strip in the damping sealing device.

The widths of the spiral tooth grooves (including the orbiting scroll spiral tooth groove 12 and the stationary scroll spiral tooth groove 22) in the high-temperature and high-pressure section (including the orbiting scroll spiral tooth groove 12*a* in the high-temperature and high-pressure section and stationary scroll spiral tooth groove 22*a* in the high-temperature and high-pressure section) and the medium-temperature and medium-pressure section (including the orbiting scroll spiral tooth groove 12*b* in the medium-temperature and medium-pressure section and stationary scroll spiral tooth groove 22*b* in the medium-temperature and medium-pressure section) are both 2.4 mm. The groove depth of the spiral tooth groove in the high-temperature and high-pressure section is 3.4 mm, and the groove depth of the spiral tooth groove in medium-temperature and medium-pressure section is 2.4 mm.

Figure 11:
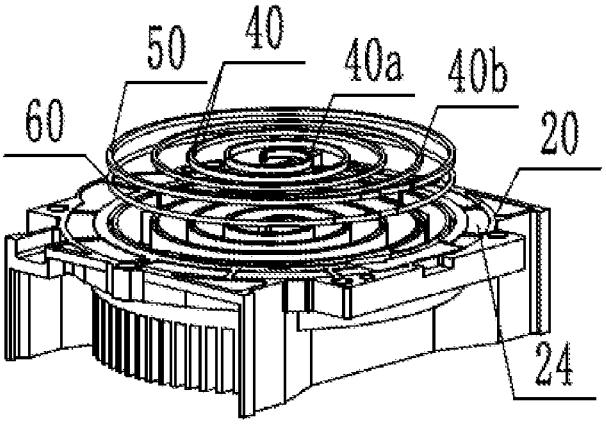
FIG. 11 is a part composition diagram of a wear-resistant sealing strip in a high-temperature and high-pressure section, a wear-resistant sealing strip in a medium-temperature and medium-pressure section, a damping and wear-resistant sealing strip, a damping elastic component and a stationary scroll.

Referring to FIG. 11, the stationary scroll wear-resistant sealing strip 40*a* in the high-temperature and high-pressure section is embedded in the stationary scroll spiral tooth groove 22*a* in the high-temperature and high-pressure section; and stationary scroll wear-resistant sealing strip 40*b* in the medium-temperature and medium-pressure section is embedded in the stationary scroll spiral tooth groove 22*b* in the medium-temperature and medium-pressure section.

Figure 12:
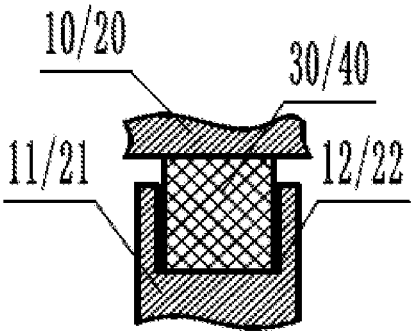
FIG. 12 is a partial cross-sectional view showing matching of a wear-resistant sealing strip and a scroll.

A partial cross-section structure showing matching of the wear-resistant sealing strip and the scroll is shown in FIG. 12.

In one embodiment, the widths of wear-resistant sealing strips (including the orbiting scroll wear-resistant sealing strip 30 and the stationary scroll wear-resistant sealing strip 40) in the high-temperature and high-pressure section (including the orbiting scroll wear-resistant sealing strip 30*a* in the high-temperature and high-pressure section and the orbiting scroll wear-resistant sealing strip 40*a* in the medium-temperature and medium-pressure section) and the medium-temperature and medium-pressure section (including the orbiting scroll wear-resistant sealing strip 30*b* in the high-temperature and high-pressure section and the orbiting scroll wear-resistant sealing strip 40*b* in the medium-temperature and medium-pressure section) are both 2.25 mm. The thickness of the wear-resistant sealing strip in the high-temperature and high-pressure section is 3.5 mm, and the thickness of the wear-resistant sealing strip in the medium-temperature and medium-pressure section is 2.5 mm.

The surface of the wear-resistant sealing strip (including the orbiting scroll wear-resistant sealing strip 30 and the stationary scroll wear-resistant sealing strip 40) is smooth and flat. In some embodiments, the wear-resistant sealing strips in the high-temperature and high-pressure section (including the orbiting scroll wear-resistant sealing strip 30*a* in the high-temperature and high-pressure section and the orbiting scroll wear-resistant sealing strip 40*a* in the medium-temperature and medium-pressure section) are a PTFE (polytetrafluoroethylene) composite material with an added filler such as copper powder, molybdenum disulfide and carbon fiber or glass fiber, etc. The wear-resistant sealing strip in the medium-temperature and medium-pressure section (including the orbiting scroll wear-resistant sealing strip 30*a* in the high-temperature and high-pressure section and the orbiting scroll wear-resistant sealing strip 40*a* in the medium-temperature and medium-pressure section) is the PTFE composite material with an added filler such as liquid crystal polymer (LCP), molybdenum disulfide, carbon fiber or glass fiber, etc. In one embodiment, the temperature resistance range corresponding to the high-temperature and high-pressure section is −260° C. to 315° C., and the temperature resistance range corresponding to the medium-temperature and medium-pressure section is −240° C. to 280° C. the PTFE composite material has good performances such as wear resistance, self-lubrication, temperature resistance, corrosion resistance and impact resistance, etc.

Figure 9:
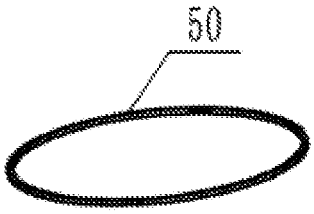
FIG. 9 is a structure diagram of a damping and wear-resistant sealing strip in a damping sealing device.
Figure 13:
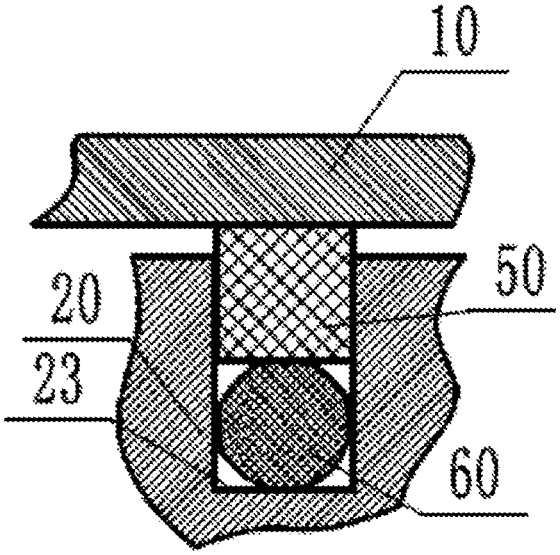
FIG. 13 is a partial cross-sectional view showing matching of a damping sealing device (which is circular) and a scroll.
Figure 14:
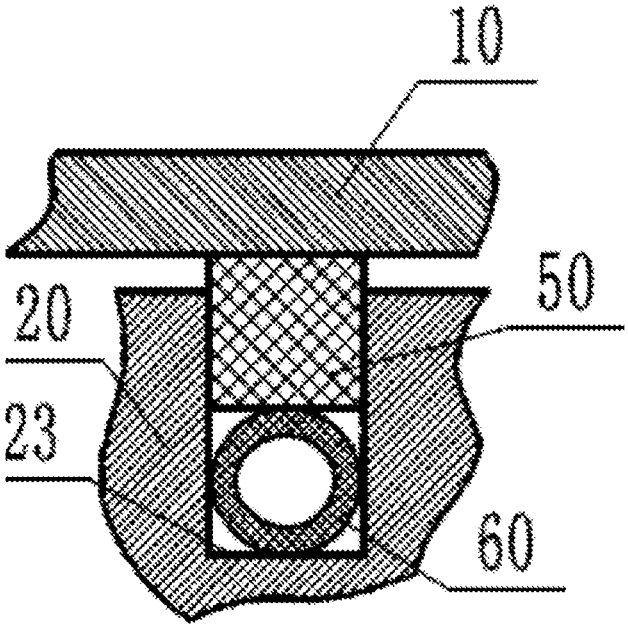
FIG. 14 is a partial cross-sectional view showing matching of a damping sealing device (which is circular) and a scroll.

Referring to FIG. 11, the stationary scroll 20 is provided with a damping sealing device, and the damping sealing device is located between the stationary scroll spiral tooth 21 of the stationary scroll 20 and the heat dissipation groove 24, and a cross section thereof is shown in FIG. 13 or FIG. 14. The elastic damping component 60 (shown in FIG. 10) is first embedded in the damping sealing groove 23 of the stationary scroll 20, and then the damping wear-resistant sealing strip 50 (shown in FIG. 9) is embedded in In the damping sealing groove 23 of the stationary scroll 20, the bottom surface of the damping wear-resistant sealing strip 50 is in close contact with the arc surface of the elastic damping component 60; and the front surface of the damping wear-resistant sealing strip 50 is closely fitted to the bottom surface of the spiral tooth of the orbiting scroll 10 by means of the rebound action of the elastic damping component 60. It should be appreciated that the elastic damping component 60 of the damping sealing device described above can also be provided in the orbiting scroll 10, and the damping wear-resistant sealing strip 50 is accordingly provided on the stationary scroll 20.

In some embodiments, the width of the damping sealing groove 23 is equal to 3 mm and the depth is equal to 2.8 mm; the width of the damping wear-resistant sealing strip 50 is equal to 2.9 mm and the thickness is equal to 2.8 mm; the surface of the damping wear-resistant sealing strip 50 is smooth and flat. In some embodiments, the damping wear-resistant sealing strip 50 is a PTFE composite material added with a filler such as polyimide (PI), molybdenum disulfide, carbon fiber or glass fiber, etc., and the heat range thereof is −220° C. to −250° C. The PTFE composite material has good properties such as wear resistance, self-lubrication, temperature resistance, corrosion resistance and impact resistance, etc. The material of the elastic damping component 60 is any one of silica gel, latex, or polyethylene, or any one of the composite materials with the silica gel, latex, or polyethylene as the matrix and other fillers, that is, the elastic damping component 60 is a composite material with a base material of silica gel or latex or polyethylene mixed with other fillers. The elasticity and plasticity of the elastic damping component 60 are better than those of the damping wear-resistant sealing strip 50.

Figure 10:
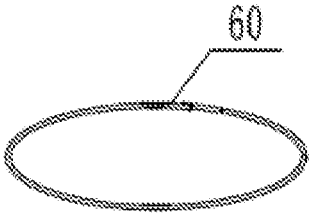
FIG. 10 is a structure diagram of a damping elastic component in a damping sealing device.

Referring to FIGS. 10 and 11, the cross section of the elastic damping member 60 in the damping sealing device has two shapes: a circular shape and a circular tube shape. In some embodiments, the cross section of the embedded elastic damping component 60 is in the shape of a circle, and the diameter of the circle is equal to 2.8 mm; the cross section of the embedded elastic damping component 60 is in the shape of a circular tube, the outer diameter of the circular tube is equal to 2.8 mm, and the wall thickness of the tube is equal to 0.5 mm. The outer diameter of the circle or circular tube is between one half and three fifths of the depth of the damping groove, and meanwhile is smaller than the width of the damping groove. The thickness of the wall of the tube with a cross section in the shape of the circular tube is less than one half of the outer diameter.

The base material of one of the orbiting scroll and the stationary scroll is cast aluminum alloy or forged aluminum alloy, and the other is powder metallurgy or cast iron. Or the base materials of the movable scroll and the stationary scroll are both cast aluminum alloy or forged aluminum alloy, and one or two of them are treated with hard anodic oxidation or micro-arc oxidation.

What is claimed is:

1. A sealing structure, comprising:

an orbiting scroll comprising an orbiting scroll spiral tooth, wherein the orbiting scroll spiral tooth is provided with an orbiting scroll spiral tooth groove, an orbiting scroll wear-resistant sealing strip is provided in the orbiting scroll spiral tooth groove, the orbiting scroll wear-resistant sealing strip comprises a first orbiting scroll wear-resistant sealing strip portion in a high-temperature and high-pressure section and a second orbiting scroll wear-resistant sealing strip portion in a medium-temperature and medium-pressure section, a thickness of the orbiting scroll wear-resistant sealing strip is greater than a depth of the orbiting scroll spiral tooth groove;

a stationary scroll comprising a stationary scroll spiral tooth matched with the orbiting scroll spiral tooth, wherein the stationary scroll spiral tooth is provided with a stationary scroll spiral tooth groove, a stationary scroll wear-resistant sealing strip is provided in the stationary scroll spiral tooth groove, the stationary scroll wear-resistant sealing strip comprises a first stationary scroll wear-resistant sealing strip portion in the high-temperature and high-pressure section and a second stationary scroll wear-resistant sealing strip portion in the medium-temperature and medium-pressure section, a thickness of the stationary scroll wear-resistant sealing strip is greater than a depth of the stationary scroll spiral tooth groove;

wherein the stationary scroll is provided with a damping sealing groove, an elastic damping component is provided in the damping sealing groove, and a damping wear-resistant sealing strip is provided on the orbiting scroll, the damping wear-resistant sealing strip abuts against the elastic damping component, an abutting portion of the damping wear-resistant sealing strip and the elastic damping component is lower than an upper end surface of the damping sealing groove; or, the orbiting scroll is provided with the damping sealing groove, the elastic damping component is provided in the damping sealing groove, the damping wear-resistant sealing strip is provided on the stationary scroll, the damping wear-resistant sealing strip abuts against the elastic damping component, the abutting portion is lower than the upper end surface of the damping sealing groove;

wherein a cross section of the elastic damping component is in a shape of a circle or a circular tube, and an outer diameter of the circle or the circular tube is between one half and three fifths of a depth of the damping sealing groove, and less than a width of the damping groove.

2. The sealing structure according to claim 1, wherein, the thickness of the orbiting scroll wear-resistant sealing strip in the high-temperature and high-pressure section is greater than the thickness of the orbiting scroll wear-resistant sealing strip in the medium-temperature and medium-pressure section, the orbiting scroll spiral tooth groove accordingly comprises the orbiting scroll spiral tooth groove in the high-temperature and high-pressure section and the orbiting scroll spiral tooth groove in the medium-temperature and medium-pressure section, the depth of the orbiting scroll spiral tooth groove in the high-temperature and high-pressure section is greater than the depth of the orbiting scroll spiral tooth groove in the medium-temperature and medium-pressure section; or, the thickness of the stationary scroll wear-resistant sealing strip in the high-temperature and high-pressure section is greater than the thickness of the stationary scroll wear-resistant sealing strip in the medium-temperature and medium-pressure section, the stationary scroll spiral tooth groove accordingly comprises the stationary scroll spiral tooth groove in the high-temperature and high-pressure section and the stationary scroll spiral tooth groove in the medium-temperature and medium-pressure section, the depth of the stationary scroll spiral tooth groove in the high-temperature and high-pressure section is greater than the depth of the stationary scroll spiral tooth groove in the medium-temperature and medium-pressure section.

3. The sealing structure according to claim 1, wherein cross sections of the orbiting scroll wear-resistant sealing strip, the stationary scroll wear-resistant sealing strip, and the damping wear-resistant sealing strip are in a shape of a square.

4. The sealing structure according to claim 1, wherein a thickness of the damping wear-resistant sealing strip is between one half and three fifths of the depth of the damping sealing groove.

5. The sealing structure according to claim 1, wherein a temperature resistance of the orbiting scroll wear-resistant sealing strip in the high-temperature and high-pressure section, a temperature resistance of the orbiting scroll wear-resistant sealing strip in the medium-temperature and medium-pressure section, and a temperature resistance of the damping wear-resistant sealing strip decrease in sequence.

6. The sealing structure according to claim 1, wherein a width of the orbiting scroll wear-resistant sealing strip is the same as that of the stationary scroll wear-resistant sealing strip.

7. The sealing structure according to claim 1, wherein surfaces of the orbiting scroll wear-resistant sealing strip, the stationary scroll wear-resistant sealing strip, and the damping wear-resistant sealing strip are smooth and flat.

8. The sealing structure according to claim 1, wherein, the orbiting scroll wear-resistant sealing strip in the high-temperature and high-pressure section and/or the stationary scroll wear-resistant sealing strip in the high-temperature and high-pressure section are made of a PTFE composite material comprising copper powder, molybdenum disulfide, carbon fiber or glass fiber, and a temperature resistance range thereof is −240° C. to 280° C.;

the orbiting scroll wear-resistant sealing strip in the medium-temperature and medium-pressure section and/or the stationary scroll wear-resistant sealing strip in the medium-temperature and medium-pressure section are made of the PTFE composite material comprising LCP, molybdenum disulfide, carbon fiber or glass fiber, and a temperature resistance range thereof is −240° C. to 280° C.;

the damping wear-resistant sealing strip is made of the PTFE composite material comprising PI, molybdenum disulfide, carbon fiber or glass fiber, and the temperature resistance range of the damping wear-resistant sealing strip is −220° C. to −250° C.;

a material of the elastic damping component is any one of silica gel, latex, or polyethylene, or any one of composite materials with silica gel, latex, or polyethylene as a matrix.

9. The sealing structure according to claim 1, wherein a heat dissipation groove is provided on the stationary scroll, the damping sealing groove is provided between the stationary scroll spiral tooth and the heat dissipation groove; or, the heat dissipation groove is provided on the orbiting scroll, and the damping sealing groove is provided between the orbiting scroll spiral tooth and the heat dissipation groove.

10. The sealing structure according to claim 1, wherein elasticity and plasticity of the elastic damping component is greater than that of the damping wear-resistant sealing strip.

11. The sealing structure according to claim 1, wherein, a base material of one of the orbiting scroll and the stationary scroll is a cast aluminum alloy or a forged aluminum alloy, and a base material of the other is powder metallurgy or a cast iron; or, the base materials of the orbiting scroll and the stationary scroll are both the cast aluminum alloy or the forged aluminum alloy, and one or both of the base materials of the orbiting scroll and the stationary scroll are treated with hard anodic oxidation or micro-arc oxidation.

12. A scroll air compressor, comprising the sealing structure according to claim 1.

13. The sealing structure according to claim 1, wherein a thickness of a wall of the circular tube with is less than one half of the outer diameter.

* * * * *